US005335701A

United States Patent [19]

Frazier

[11] Patent Number: 5,335,701

[45] Date of Patent: Aug. 9, 1994

[54] TIE-BAR TOOL FOR ATTACHING FENCING WIRE TO A POST WITH A TIE-WIRE CLIP

[76] Inventor: Donald L. Frazier, P.O. Box 434, Lordsburg, N. Mex. 88045

[21] Appl. No.: 135,756

[22] Filed: Oct. 12, 1993

Related U.S. Application Data

[63] Continuation-in-part of Ser. No. 890,841, Jun. 1, 1992, abandoned.

[51] Int. Cl.[5] ..... B21F 15/04

[52] U.S. Cl. ..... 140/57; 140/117

[58] Field of Search ..... 7/117; 140/52, 56, 57, 140/117, 118, 123, 124, 93 D

[56] References Cited

U.S. PATENT DOCUMENTS

| | | | |
|---|---|---|---|
| 606,120 | 6/1898 | Carter | 140/117 |
| 758,829 | 5/1904 | Dodd | 140/57 |
| 898,912 | 9/1908 | Neller | 140/117 |
| 2,570,575 | 10/1951 | Lindbloom | 140/118 |
| 3,805,854 | 4/1974 | Self | 140/117 |
| 4,485,852 | 12/1984 | Frazier | 140/118 |

*Primary Examiner*—Lowell A. Larson

*Attorney, Agent, or Firm*—Robert W. Becker & Associates

[57] ABSTRACT

A tool for attaching fencing wire to a post with a tie-wire clip. The tool has an essentially cylindrical bar. One end of the bar is tapered and ends in a flat surface that is provided with a blind hole that extends into the bar beyond where the taper begins. The other end of the bar is also cylindrical but has a diameter that is less than the diameter of the central portion of the bar, which forms a grip portion between the two ends of the tool.

8 Claims, 1 Drawing Sheet

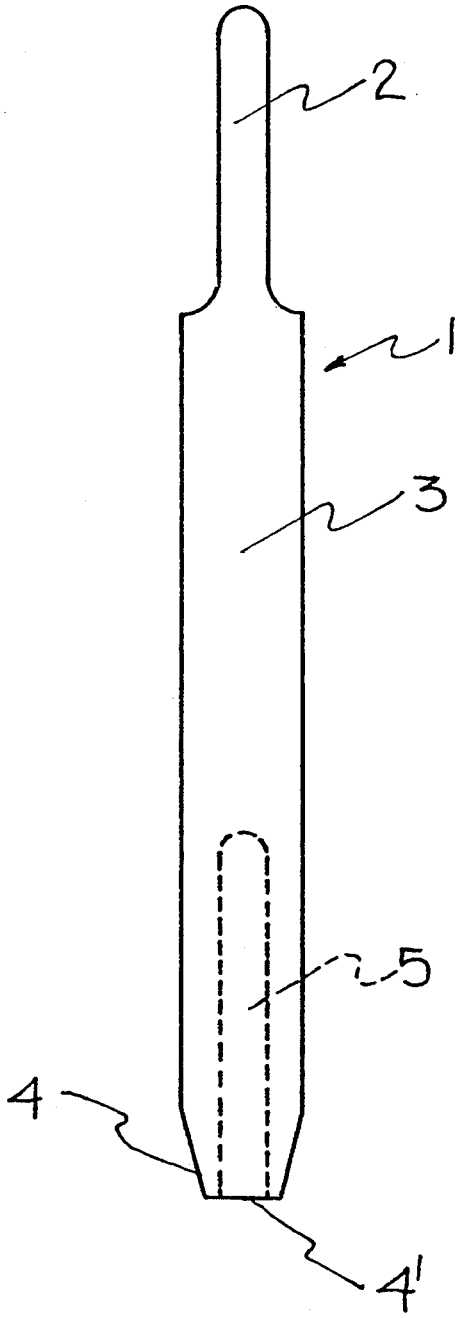
2
1
3
5
4
4'

TIE-BAR TOOL FOR ATTACHING FENCING WIRE TO A POST WITH A TIE-WIRE CLIP

This application is a continuation-in-part application of parent U.S. Ser. No. 07/890,841 filed Jun. 1, 1992, now abandoned.

BACKGROUND OF THE INVENTION

The present invention relates to a tool for attaching fencing wire to a post with a tie-wire clip.

Although various tools for attaching fencing wire to a post have been proposed, a satisfactory tool for accomplishing such attachment has never been developed.

It is therefore an object of the present invention to provide a tool that is simple yet provides for a very effective and satisfactory attachment of a fencing wire to a post.

BRIEF DESCRIPTION OF THE DRAWING

This object, and other objects and advantages of the present invention, will appear more clearly from the following specification in conjunction with the accompanying schematic drawing, which illustrates one exemplary embodiment of the inventive tie-bar tool.

SUMMARY OF THE INVENTION

The inventive tool comprises an essentially cylindrical bar having a first end, a central grip portion, and a second end, wherein the first end is tapered and ends in a flat surface that extends transverse to the longitudinal direction of the bar, with the flat surface of the first end being provided with a blind hole that extends partially into the bar in the longitudinal direction thereof and beyond where the taper begins, and wherein the second end of the bar is also cylindrical but is of a reduced diameter relative to the central grip portion of the bar, which is disposed between the first and second ends thereof.

The advantage of the inventive tie-bar tool is that it actually has two functional ends, one on either side of a central grip portion. These two ends are quite different from one another with each having a unique configuration. In particular, one end has a blind hole with which an end of a clip can be wrapped around a wire, with the taper that is provided at that end allowing the tool to again become detached from the end of the clip after the same has been wrapped around the wire. The other, reduced diameter end of the tool allows this end to be inserted into a loop of the clip and to bring this loop around the fence wire.

Further specific features of the present invention will be described in detail subsequently.

DESCRIPTION OF PREFERRED EMBODIMENTS

Referring now to the drawing in detail, the tool or tie-bar 1 is made from a single piece of solid material, such as a rod of carbon steel or even plastic. The rod or bar is essentially cylindrical, and has an end 2, a central grip portion 3, and an opposite end 4. The end 4 comprises a short tapered end that ends in a flat surface 4' that extends transverse to the longitudinal direction of the tool 1. The flat surface 4' is provided with a blind hole 5 that extends partially into the bar in the longitudinal direction thereof, and in particular extends beyond where the taper begins and into the central grip portion

3. The other end 2 of the bar is also cylindrical, but has a reduced diameter relative to the diameter of the central portion 3. The far end of this end 2 can be rounded.

As indicated previously, the inventive tie-bar tool 1 is used to attach a fence wire to a post with a tie-wire clip. To accomplish this, a loop of a tie-wire clip is placed over the fence wire; the loop can actually be formed in the clip with the inventive tool, namely by placing one end of the clip in the hole 5 of the tapered end 4 and twisting the end of the clip back toward the remainder of the clip. After the tie-wire clip has been removed from the hole 5 of the tool 1 and the loop has been placed over the fence wire and the clip has been drawn around the post, the reduced-diameter end 2 of the tool 1 is placed between the fence wire and a second loop at the other end of the tie-wire clip. The tool 1 is pivoted about the fence wire, bringing the second loop of the tie-wire clip along with it. The reduced-diameter end 2 of the tool 1 ultimately detaches from the clip, but not until the clip has looped itself around the fence wire. To complete attachment of this end of the clip to the fence wire, the end of the clip is inserted into the hole 5 of the tapered end 4 of the tool 1. To wrap the end of the clip around the fence wire, the tool is again pivoted about the fence wire until it detaches. This detachment of the tapered end 4 of the tool 1 from the end of the clip is possible only due to the tapered nature of the end 4. If this end were also cylindrical, it would not be possible for the tool 1 to slide off of the end of the clip after the clip has been wrapped around the fence wire. The other end of the tie-wire clip is now similarly inserted into the hole 5 of the tapered end 4 of the tool 1, and the tool is then again pivoted about the fence wire (bringing the end of the clip along with it) until the tapered end 4 slides off of the clip.

From the foregoing explanation it is clear that the inventive tool 1 has two very differently configured functional ends, both of which play a significant role in effective attachment of a fence wire to a post with a tie-wire clip.

By way of example only, pursuant to one specific embodiment of the inventive tie-bar tool 1, the central grip portion 3 can be approximately ½ inch in diameter and 5 and ⅞ inches in length, with the cylindrical, reduced-diameter end 2 being approximately ¼ inch in diameter and 1 ½ inches in length; the tapered end 4 is about ⅝ inch in length, with the blind hole 5 being ⅛ inch in diameter and approximately 2 and ½ inches long. The angle of the tapered end 4 is approximately 12° relative to the longitudinal direction of the tool 1.

The present invention is, of course, in no way restricted to the specific disclosure of the specification and drawing, but also encompasses any modifications within the scope of the appended claims.

I claim:

1. A tool for attaching fencing wire to a post with a tie-wire clip, said tool comprising:

an essentially cylindrical bar having a first end, a central grip portion, and a second end, wherein said first end is tapered and ends in a flat surface that extends transverse to a longitudinal direction of said bar, with said flat surface of said first end being provided with a blind hole that extends partially into said bar in said longitudinal direction thereof and beyond where said taper beings, and wherein said second end of said bar is also cylindrical but is of a reduced diameter relative to said central grip portion of said bar, which is disposed between said first and second ends thereof.

2. A tool according to claim 1, wherein an end of said second end of said bar that is remote from said first end thereof is rounded.

3. A tool according to claim 2, wherein said bar is made of metal.

4. A tool according to claim 2, wherein said bar is made of plastic.

5. A tool according to claim 2, wherein said hole in said first end of said bar does not extend as far as said second end thereof.

6. A tool according to claim 1, wherein said second end of said bar has a diameter that is approximately $\frac{1}{2}$ that of said central grip portion.

7. A tool according to claim 6, wherein said central grip portion has a diameter of approximately $\frac{1}{2}$ inch, and said second end of said bar has a diameter that is approximately $\frac{1}{4}$ inch.

8. A tool according to claim 1, wherein said first end of said bar is provided with a taper angle that extends at approximately 12° relative to said longitudinal direction of said bar.

* * * * *